US007348934B2

(12) United States Patent
Kuroda et al.

(10) Patent No.: US 7,348,934 B2
(45) Date of Patent: Mar. 25, 2008

(54) LENS ANTENNA SYSTEM

(75) Inventors: Masatoshi Kuroda, Osaka (JP); Tetsuo Kishimoto, Osaka (JP); Takaya Ogawa, Kanagawa (JP)

(73) Assignees: Sumitomo Electric Industries, Ltd., Osaka (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/543,834

(22) PCT Filed: Jan. 30, 2003

(86) PCT No.: PCT/JP03/00947

§ 371 (c)(1),
(2), (4) Date: Jul. 29, 2005

(87) PCT Pub. No.: WO2004/068636

PCT Pub. Date: Aug. 12, 2004

(65) Prior Publication Data

US 2006/0145940 A1 Jul. 6, 2006

(51) Int. Cl.
*H01Q 15/08* (2006.01)

(52) U.S. Cl. ..... 343/911 R; 343/911 L

(58) Field of Classification Search ..... 343/911 R, 343/911 L, 909, 753, 761, 766, 757
See application file for complete search history.

(56) References Cited

U.S. PATENT DOCUMENTS 5,922,039 A 7/1999 Welch et al.
6,034,642 A * 3/2000 Kojima et al. ..... 343/753
2004/0263418 A1* 12/2004 Kuroda et al. ..... 343/909

(Continued)

FOREIGN PATENT DOCUMENTS

EP A-1014492 6/2000

(Continued)

OTHER PUBLICATIONS 0370300.2-2220, PCT/JP0300947, filed Feb. 2, 2006, Sumitomo Electric Industries, Ltd., et al.

(Continued)

*Primary Examiner*—Hoanganh Le
(74) *Attorney, Agent, or Firm*—McDermott Will & Emery LLP

(57) ABSTRACT

A compact lens antenna assembly A which is a Luneberg lens antenna comprising a hemispherical lens and a reflecting plate so as to converge incoming radio waves on a feed, and which can receive radio waves from not only a geostationary satellite or an orbiting satellite with high gain even if the incidence angle of the incoming radio waves is large includes lens antenna body 10 including a base plate 11, a reflecting plate 13 and a hemispherical lens 14 made by laminating dielectric materials. The plate 13 and the lens 14 are rotatably mounted on the base plate 11. The antenna body further includes feeds 16*a* and 16*b* that can be moved to a desired position along guide rails 15. The antenna assembly further includes a reflecting plate support means 20 mounted on a base 21 and capable of inclining the reflecting plate 13 in a desired direction. By inclining the reflecting plate 13, the incidence angle of radio waves from the satellite is adjustable to a value within a predetermined range.

6 Claims, 8 Drawing Sheets

U.S. PATENT DOCUMENTS

| | | | | |
|---|---|---|---|---|
| 2006/0145940 | A1* | 7/2006 | Kuroda et al. | 343/11 R |
| 2006/0262031 | A1* | 11/2006 | Kuroda et al. | 343/11 R |

FOREIGN PATENT DOCUMENTS

| | | |
|---|---|---|
| JP | 6-504659 | 5/1994 |
| JP | 7-505018 | 6/1998 |
| JP | 2001-044746 | 2/2001 |
| JP | 2002-513230 | 5/2002 |
| JP | 2002-513231 | 5/2002 |
| JP | 2002-232230 | 8/2002 |
| JP | 2004-180342 * | 6/2004 |

OTHER PUBLICATIONS 03703100.2-1248, filed Jun. 16, 2006, Sumitomo Electric Industries, Ltd.

Smith A. C., et al.: "An Innovative Mobile Satcom Antenna", IEE Colloquium On Mechanical Aspects of Antenna Design, Apr. 24, 1989 (Apr. 24, 1989), pp. 9/1-9/7, XP00320230 London, UK.

EP, Mar. 15, 2007, European Office Communication.

* cited by examiner (a)

(b)

LENS ANTENNA SYSTEM

This application is a 371 of PCT/JP03/00947 filed on Jan. 30, 2003.

TECHNICAL FIELD TO WHICH THE INVENTION PERTAINS

This invention relates to a lens antenna assembly capable of converging radio wave using a spherical lens and suitable for use in e.g. a satellite communication system.

PRIOR ART

Various lens antenna assemblies have been proposed, such as Luneberg lens antennas, which include a spherical lens formed of a dielectric material for converging radio wave to a focal point, and a feed movable to the focal point to collect radio waves. Such a lens antenna assembly can receive and transmit radio waves simply by moving the feed to the focal point without the need to move the entire device as with a parabolic antenna. Thus, such a lens antenna can be made small and compact in size.

Such a lens antenna assembly is disclosed in JP patent publication 6-504659. The antenna assembly disclosed in this publication includes a lens for receiving and transmitting electromagnetic wave, and a feed line in the form of a helical coil. It is a compact antenna assembly which can receive electromagnetic wave signals in the form of microwaves from different directions. The lens is a hemispherical lens so as to reduce the size of the antenna assembly and thus to reduce its manufacturing cost. This publication also proposes to reduce the aperture blocking, thereby improving the receiving efficiency and reducing the length of the necessary feeder cable.

JP patent publication 7-505018, which is titled "Material technique for dielectrics of antennas", discloses a method of manufacturing a dielectric lens antenna, and a lens antenna assembly thus manufactured. The dielectric lens is formed by fusing together hollow, spherical dielectric beads having a diameter smaller than the wavelength of radio waves to be received or transmitted so that its dielectric constant is constant or variable. The antenna assembly disclosed in this publication comprises the abovementioned dielectric lens and a reflecting plate that protrudes from the outer edge of the lens.

In the specification of this publication, there is a description that in such a virtual dielectric lens antenna, if the incidence angle is not perpendicular to the reflecting plate, the loss of its gain decreases. This publication also teaches that the length 1 of the portion of the reflecting plate protruding from the reflecting plate is calculated by the equation: $1=R\times((1/\cos(be))-1)$. With this arrangement, for the primary feed, if an antenna outside of the outer edge of the lens is used in receiving radio waves, the assembly can more flexibly receive radio waves from different directions. The specification explains that this is because the feed line (power supply line) has a greater physical separation, so that no aperture blocking occurs.

In JP patent application 2001-25732, one of the applicants of the present invention proposed a lens antenna assembly comprising a hemispherical lens for converging radio wave, a radio wave reflecting plate supporting the flat circular surface of the hemispherical lens for reflecting incoming radio waves from the sky, a feed which can be moved to a focal point of the hemispherical lens where incoming radio waves converge and having an antenna element for receiving radio wave, an azimuth angle adjusting means for controlling the azimuth angle of radio wave by moving the feed around the azimuth axis of the hemispherical lens, and an elevation angle adjusting means for adjusting the elevation angle of incoming radio wave by moving the feed around an elevation axis.

Problems to Which the Invention Seeks a Solution

This lens antenna assembly includes a lens which is small in size and lightweight, so that the entire lens antenna assembly is also small in size and lightweight. Also, the lens is easy to handle, manufacture and assemble. As the lens, a hemispherical lens is used which can receive radio waves from geostationary satellites. The radio waves received are reflected by a radio wave reflecting plate and can be received by a feed provided on a focal point on a side peripheral surface opposite to the incident side of the hemispherical lens. Conversely, radio waves from the feed can be directed toward geostationary satellites. Since such a hemispherical lens is half the size and weight of conventional spherical lenses, the entire assembly can be made small in size and weight.

Thus, in order to effectively increase the gain, it is necessary to use a reflecting plate having a large diameter compared to the diameter of the lens, and thus a large antenna assembly. Specifically, in order to obtain the maximum gain, the reflecting plate has to have a diameter not less than $R/\cos\theta$ (where R is the diameter of the lens and $\theta$ is the incidence angle). This value increases exponentially with the value $\theta$, i.e. the incidence angle. Thus, in order to achieve a maximum gain at a high incidence angle, an extremely large reflecting plate will be needed (see e.g. FIG. 8(*a*)).

If the incidence angle is small as shown in FIG. 8(*b*), the feed will be in the way of incoming radio waves, thus lowering the gain. The feed cannot be moved from the position shown because it has to be located on the focal point of the incoming radio waves, which is in turn determined by the incidence angle of the incoming radio waves.

An object of the present invention is to provide a compact lens antenna assembly which is a Luneberg lens antenna comprising a hemispherical lens and a reflecting plate so as to converge incoming radio waves on a feed, and which can receive radio waves from not only a geostationary satellite or an orbiting satellite with high gain even if the incidence angle of the incoming radio waves is large.

Means for Solving the Problems

According to the present invention, there is provided a lens antenna assembly comprising a hemispherical lens made of a dielectric material for converging radio wave, a radio wave reflecting plate having a greater diameter than the hemispherical lens and provided on the flat surface of the hemispherical lens, a feed for receiving and transmitting radio wave, the feed being movable to a focal point of the hemispherical lens, and a reflecting plate support means for supporting the radio wave reflecting plate so as to be inclinable in any desired direction, thereby adjusting the inclination angle of the reflecting plate such that the incidence angle of radio waves incident on the hemispherical lens will be within a predetermined range.

The lens antenna assembly according to the present invention can be mounted not only on a rooftop of a building or its side (a wall or a fence of a veranda), but also on a moving object such as a motor vehicle, aircraft or ship to receive or transmit radio waves from and to an geostationary satellite or an orbiting satellite. In the specification, the operation of the lens antenna assembly is described mainly when receiving radio waves from a satellite or satellites. But it is to be understood that the lens antenna assembly according to the present invention can be used to transmit radio waves to a satellite or satellites. When transmitting radio waves, the reflecting plate is inclined to adjust the emergent angle of outgoing radio waves. If the incidence angle is not too large and not too small, however, the reflecting plate is not inclined.

Not only radio waves directly incident on the hemispherical lens, but also radio waves incident on the lens after having been reflected by the portion of the reflecting plate protruding from the lens converge on a focal point due to the fact that the hemispherical lens comprises a plurality of layers each formed of a dielectric material having a different dielectric constants from the other dielectric material. The feed is moved to the focal point to collect radio waves.

Thus, radio waves can be received or transmitted with a high gain.

If the satellite from which radio waves are to be received is located right over the lens antenna assembly, and if the reflecting plate is not inclined and remains horizontal, the focal point will be located near the top of the hemispherical lens. Since the feed has to be moved to the focal point, the feed will be in the way of the incoming radio waves. This reduces the gain. Thus, to avoid this, the reflecting plate is inclined to raise its side from which the radio waves enter the lens, thereby increasing the incidence angle of the radio waves. By inclining the reflecting plate in this direction, the feed will move out of the way of the incoming radio waves, so that the gain will remain high.

If the satellite from which radio waves are to be received is at a low angle in the sky, and thus the incidence angle of the incoming radio waves is large, the focal point will be at a low position of the hemispherical lens. In this state, any radio waves that are reflected by the portion of the reflecting plate protruding from the lens will enter the hemispherical lens near the maximum-diameter portion of the lens, thus destabilizing the directivity. In this case, the reflecting plate is inclined in such a direction that the incidence angle of incoming radio waves including those reflected by the portion of the reflecting plate protruding from the lens decreases. By inclining the reflecting plate in this direction, radio waves which were reflected by the reflecting plate near its outer edge of the portion protruding from the lens will now be reflected near the hemispherical lens, so that the directivity will stabilize, and thus radio waves can effectively converge on the focal point without the need to increase the size of the reflecting plate. The gain thus improves.

As mentioned above, the lens antenna assembly according to the present invention is ordinarily installed with its radio wave reflecting plate in a horizontal position. But it can also be mounted on a vertical wall such that the reflecting plate is parallel to the vertical wall. In this case, the relation between the incidence angle and the angle of the satellite in the sky is reverse to such relation when the antenna assembly is mounted on a horizontal surface. That is, if the antenna assembly is mounted on a vertical surface, the greater the incidence angle of incoming radio waves, the higher the angle of the satellite in the sky. But in either case, the reflecting plate is inclined such that the incidence angle will be always kept in such a range that the gain is maximum.

EMBODIMENTS

Figure 1:
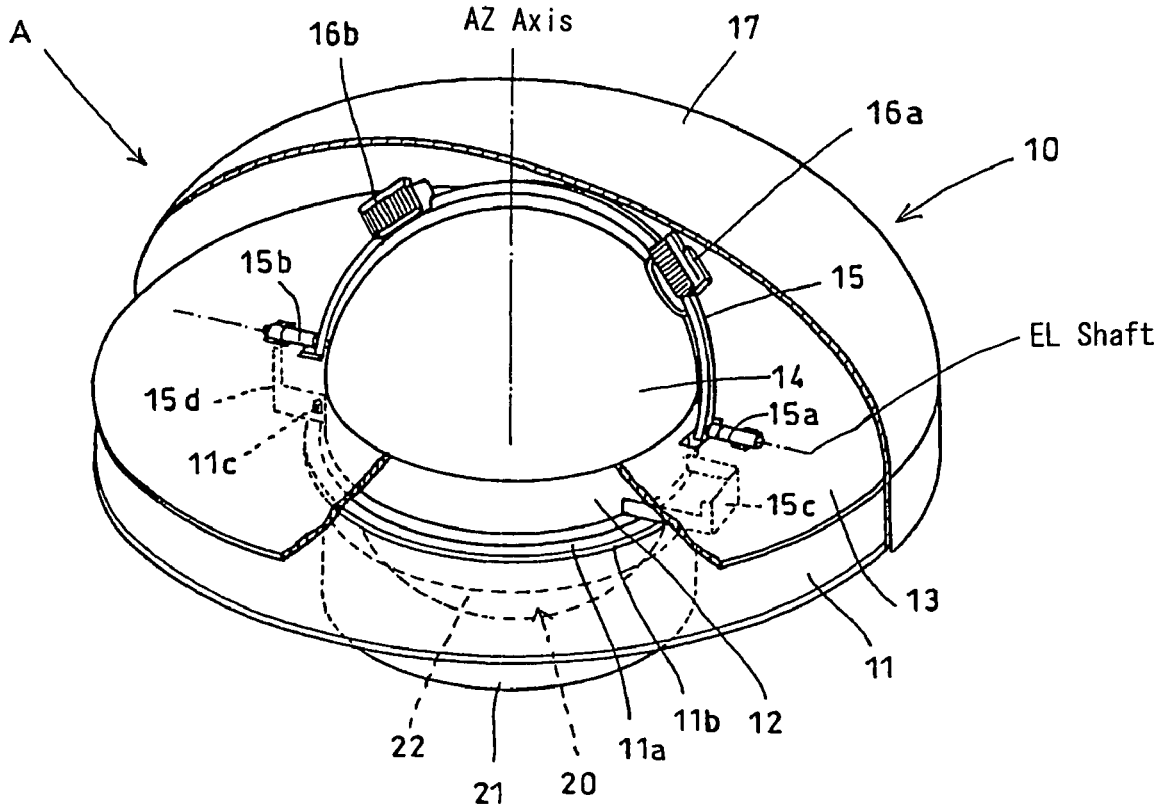
FIG. 1 is a perspective view of a lens antenna assembly according to a first embodiment.

The embodiments are now described with reference to the drawings. FIG. 1 is a partially cutaway perspective view of the lens antenna assembly A according to the first embodiment of the present invention. The lens antenna assembly shown is a Luneberg lens antenna assembly and includes a lens antenna body 10, and a reflecting plate support means 20 supporting a reflecting plate mounted in the antenna body 10 so as to be inclinable in any two-dimensional direction. First, description is briefly made of the lens antenna body 10, which is basically identical in structure to the lens antenna body of the lens antenna assembly disclosed in the first embodiment of the aforementioned applicant's preceding patent application JP 2001-025732.

The lens antenna body 10 comprises a disk-shaped base plate 11 fixed to a movable support member of the reflecting plate support member 20, which will be described later; a disk-shaped radio wave reflecting plate 13 substantially equal in diameter to the base plate 11 and fixed to a turntable 12 mounted on the base plate 11 so as to be rotatable about an azimuth (AZ) axis; a hemispherical lens 14 fixed to the reflecting plate 13 with its center on the AZ axis; first and second feeds 16*a* and 16*b* which can slide along a guide rail 15; and a cap-shaped radome 17 fixed to the base plate 11 so as to cover the hemispherical lens 14.

Figure 2:
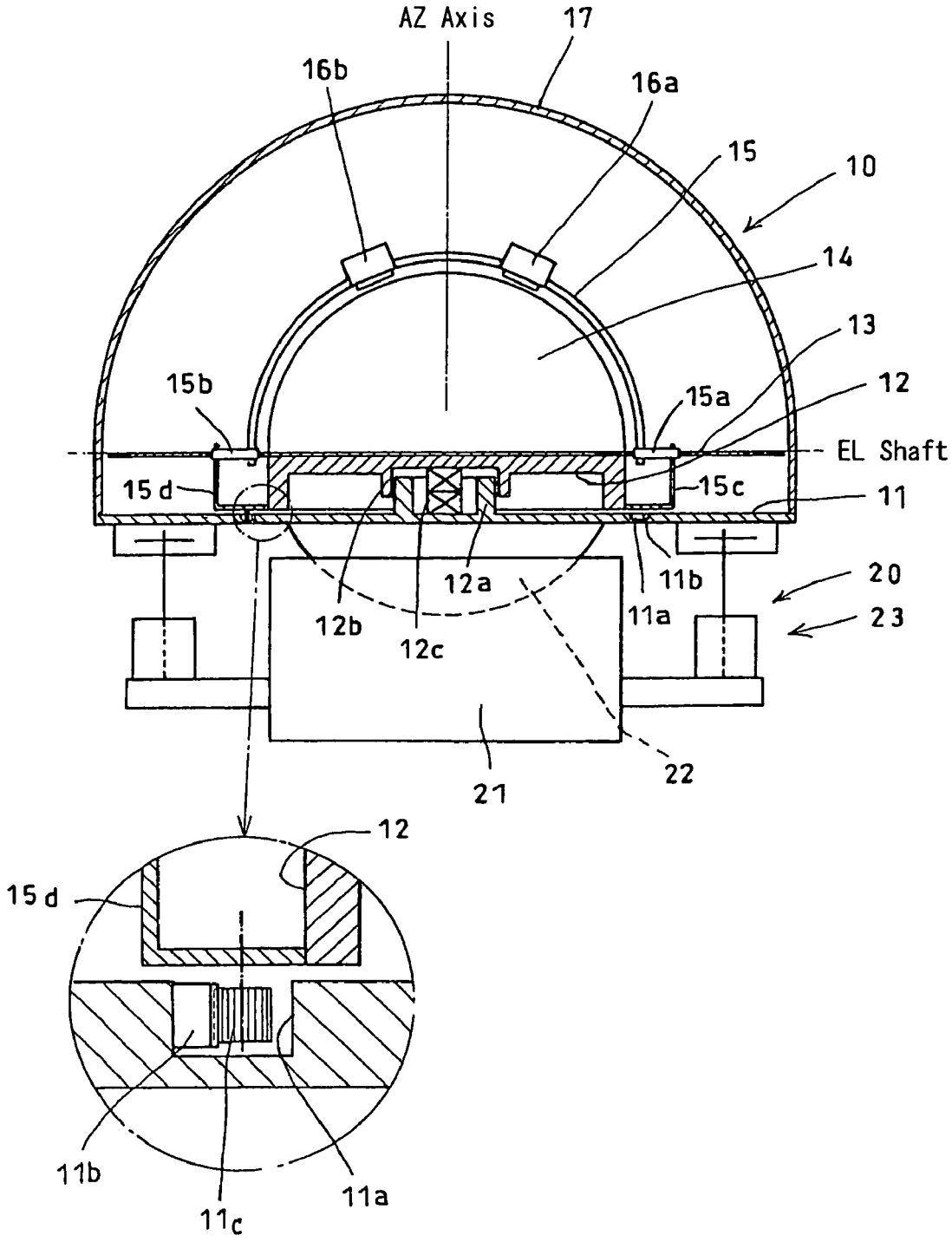
FIG. 2 is a vertical sectional view of the same.

As shown in FIG. 2, the turntable 12 has a hub 12*b* formed on the bottom thereof and rotatably fitted around a short protrusion 12*a* formed on the top of the disk-shaped base plate 11 at its center through a bearing. Ideally, the reflecting plate 13 has as large a flat surface area as possible. But actually, its surface area is limited by permissible ranges of various properties of the antenna (such as gains and side lobes). The hemispherical lens is one of the two halves of a spherical lens obtained by cutting the spherical lens along a plane including the center of the spherical lens. Since its flat surface along which the hemispherical lens is divided is in contact with the reflecting plate 13, the hemispherical lens 14 practically serves as a spherical lens.

A typical Luneberg lens antenna assembly includes a hemispherical electromagnetic lens comprising a plurality of hemispherical shells having different inner and outer diameters from each other and concentrically laminated one on another to form a hemisphere. Each hemispherical layer is formed of a dielectric material having a dielectric constant $\epsilon r$ which satisfies the following relation:

$$\epsilon r = 2-(r/R)^2$$

where R is the outer diameter of the lens and r is the distance between the center of the lens and the corresponding shell.

With this arrangement, radio waves incident on the lens converge on a focal point. The shells have such dielectric constants that each shell has a lower dielectric constant than any shell provided inside of said each shell. Dielectric materials have paraelectricity, ferroelectricity or antiferroelectricity, and have no electrical conductivity.

The guide rail 15 is adapted to be pivoted about elevation (EL) shafts 15*a* and 15*b* by a first motor, not shown, to such an elevation angle that incoming radio waves converge on the feeds 16*a* and 16*b*. The EL shafts 15*a* and 15*b* have their respective axes aligned with each other in the plane including the surface of the reflecting plate 13 such that the guide rail 15 can pivot about the EL shafts by 180 degrees along the hemispherical lens 14.

The first motor is mounted on a motor support 5*c* mounted to the turntable 12 right under the EL shaft 15. The first motor has an output shaft connected to the EL shaft 15*a* through pulleys and a belt to rotate the EL shaft 15*a* in either direction. The first and second feeds 16*a* and 16*b* can be moved individually along the guide rail 15 by drive units mounted on the respective feeds 16*a* and 16*b*.

The turntable 12, on which the reflecting plate 13 and the hemispherical lens 14 are fixedly mounted, is rotated by a second motor about the AZ axis relative to the base plate 11 to adjust the azimuth positions of the respective feeds such that incoming radio waves converge on the feeds. More specifically, the second motor is mounted on a motor support 15*d* mounted to the turntable 12 under the EL shaft 15*b*, and carries on its output shaft a pinion 11*c* meshing with a ring-shaped rack 11*b* secured to the inner wall of an annular groove 11*a* formed in the base plate 11 and having a diameter slightly larger than the turntable 12. Thus, by turning the pinion 11*c* with the second motor, the pinion 11*c* will move along the ring-shaped rack 11*b*. That is, the turntable 12 will turn relative to the base plate 11 about its protrusion 12*a*. The base plate 11 and the turntable 12 are electrically connected together through a rotary joint 12*c* mounted in the space defined by the protrusion 12*a* and the hub 12*b*.

Through the rotary joint 12*c* and an up/down (U/D) converter provided on the turntable 12, electric power is supplied to the first and second motors and the drive units for the first and second feeds from a power source mounted on the base plate, and signals are transmitted between these drive units as well as the first and second feeds and various control units mounted on the base plate 11. Each of the feeds 16*a* and 16*b* has an antenna element through which radio wave is transmitted and received, and an electronic circuit for processing radio wave which is connected to the U/D converter. The drive unit for each feed is a motor having its output shaft meshing with a rack secured to the guide rail. Thus, by driving the respective motor, each feed can be moved along the guide rail.

The hemispherical lens 14 is made of a dielectric material, typically a foamed or non-foamed synthetic resin. Titanium oxide or titanate alkali earth metallic salts may be added thereto. A foamed synthetic resin may be formed by chemical foaming which comprises the steps of adding a gas-producing foaming agent to a synthetic resin or resin composition, decomposing it by heating, and foaming it in a mold having a desired shape.

Otherwise, a foamed synthetic resin may be obtained by pre-expanding, outside of a mold, a pelletized synthetic resin or resin composition impregnated with a volatile foaming agent, putting it in the mold having a predetermined shape, and reexpanding by heating in the presence of water vapor and simultaneously fusing adjacent beads (bead expansion).

The reflecting plate may be formed of any metal, but is preferably formed of aluminum because aluminum is lightweight and relatively inexpensive. Also, it may be a foamed or non-foamed synthetic resin board or an FRP board on which a thin metallic plate is laminated, or such a board plated with a metal. Further, the reflecting plate may be a metal plate having pores that are sufficiently small compared to wavelengths of incoming radio waves or a metal mesh having a sufficiently small mesh size compared to the wavelengths of incoming radio waves. But such a metal plate or mesh has to have a sufficiently smooth surface so as to reflect radio waves as intended. For the same reason, the reflecting plate has to be sufficiently flat, that is, it must not be warped or deflected.

The radome may be formed of any material that is sufficiently high in penetrativity of radio wave, and can sufficiently protect the inner components of the antenna assembly against the elements. For example, the radome may be formed of any synthetic resin that is high in weather resistance, but is preferably formed of a thermoplastic synthetic resin of the hydrocarbon family such as polyethylene, polystyrene or polypropylene, because these synthetic resins are low in dielectric loss.

Now description is made of the reflecting plate support means 20. It comprises a short columnar base 21, a hemispherical member 22 pivotally received in a recess 21*a* formed in the top of the base 21 and supporting the reflecting plate 13 on its flat surface, and a plurality of (3 in the figure) pulling means 23 angularly spaced apart from each other as viewed from top for inclining the hemispherical member 22 in a desired direction.

The hemispherical member 22 is formed with many grooves in its hemispherical surface to keep a lubricant in the grooves, thereby allowing smooth sliding of the hemispherical member 22 in the recess 21*a* and thus smooth pivoting of the reflecting plate 13. The pulling means 23 are mounted on a support 24 rotatably mounted on the base 21 through a bearing 24*a*, and each include a motor 25 having its output shaft in threaded engagement with a threaded rod 25*b* in a rotation transmission mechanism 25*a*. Thus, each threaded rod 25*b* can be extended or retracted by rotating the output shaft of the corresponding motor 25. The threaded rods 25*b* have their tips coupled to coupling members 26 fixed to the base plate 11, so that the base plate 11 can be pivoted by synchronously extending and retracting the respective threaded rods 25*d*.

Figure 3:
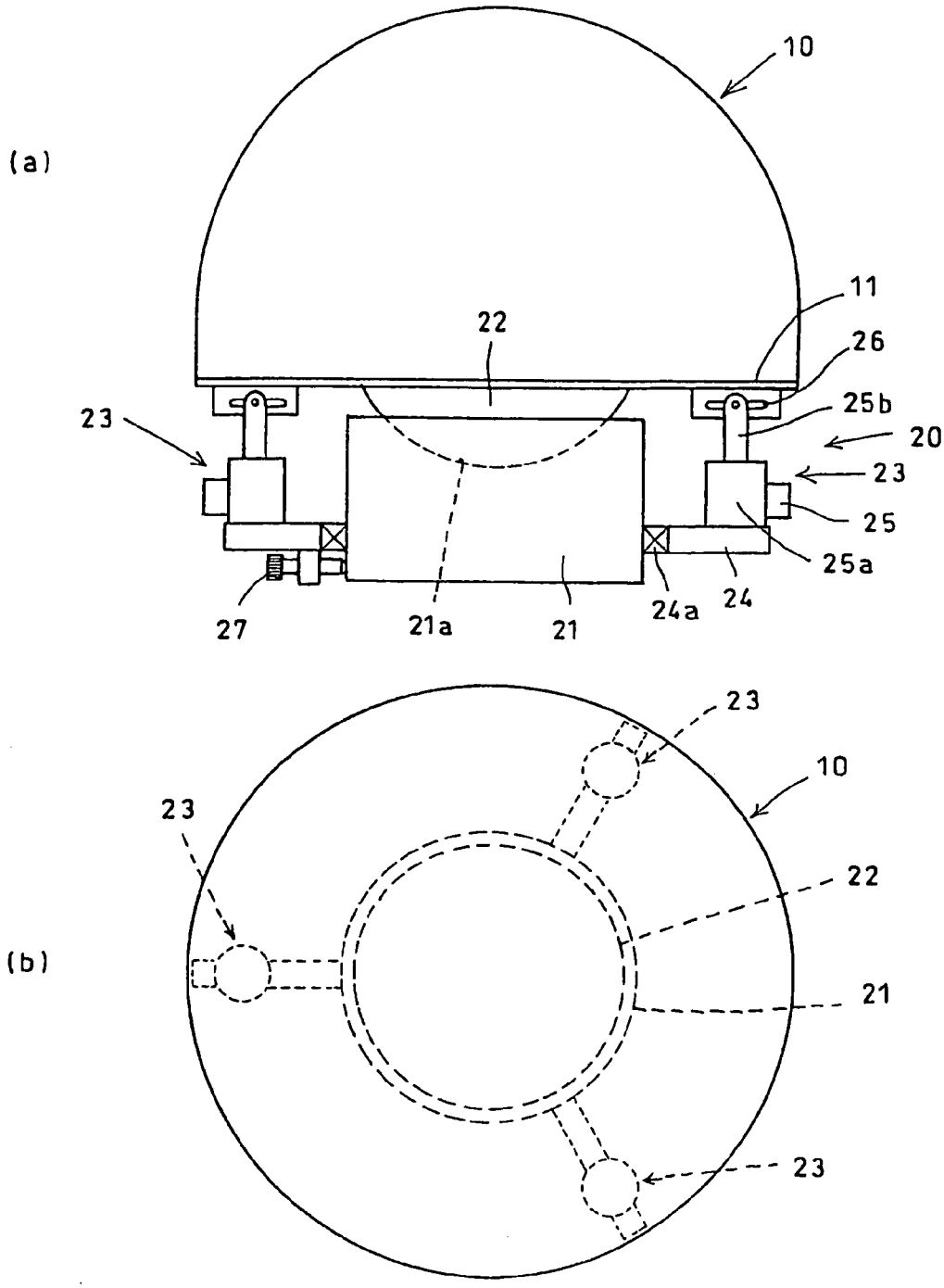
FIGS. 3(*a*) and 3(*b*) show a reflecting plate support means.

Each threaded rod 25 has its tip engaged in an elongated hole formed in the corresponding coupling member 26 so as to be inclinable when it is extended or retracted. As shown in FIG. 3(*b*), the three pulling means 23 are angularly spaced apart from each other by 120 degrees. But in FIG. 3(*a*), in order to facilitate understanding of the pulling means 23, two of the three pulling means 23 are shown as being spaced apart from each other by 180 degrees. Before actual use, the support 24 is fixed to the base 21 by fixing means 27 to keep the pulling means 23 from rotating relative to the base 21. The fixing means 27 shown comprises a threaded bolt in threaded engagement with a nut member secured to the support 24. By turning the bolt, its tip abuts the base 21, thereby preventing rotation of the support 24 relative to the base 21. But the fixing means 27 is not limited to the arrangement shown if it can prevent rotation of the support 24.

The lens antenna assembly according to the present invention can be mounted on top of the roof of a building or its side (such as a wall or a fence of a veranda), or can be mounted on a moving object such as a motor vehicle, aircraft or ship. Also, the lens antenna assembly according to the present invention can be used for communication not only between a ground station and geostationary satellites but also between a ground station and orbiting satellites. In the description of both the first and second embodiments, description is mainly made of how radio waves are received from satellites. But the antenna assembly can also transmit radio waves toward satellites.

Figure 4:
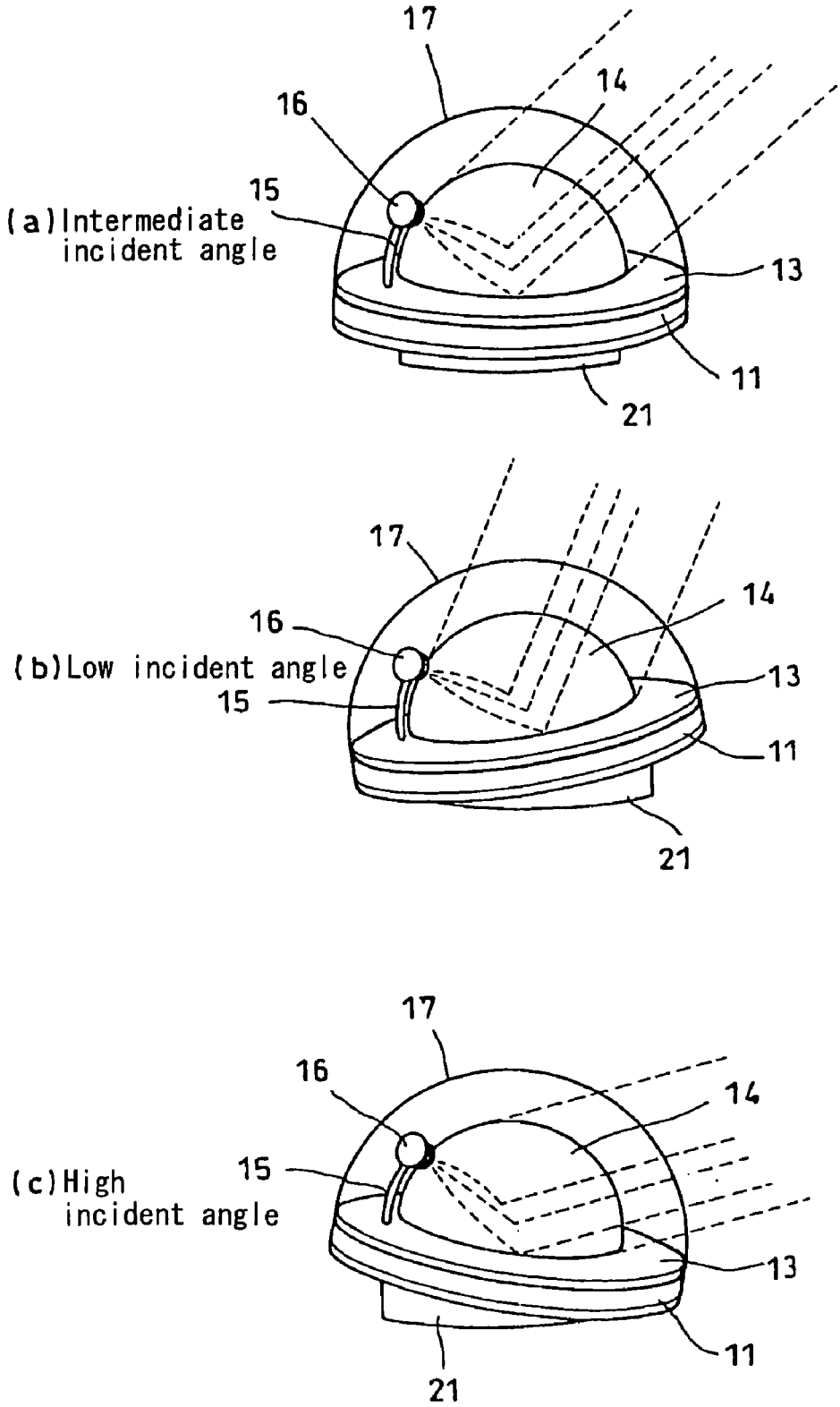
FIG. 4(*a*) to 4(*c*) show the operation of the lens antenna assembly of FIG. 1.

In order to receive radio waves from (or transmit radio waves to) a geostationary satellite located at a high position in the sky as seen from the antenna assembly, the reflecting plate 13 is kept horizontal to receive radio waves at an intermediate incidence angle as shown in FIG. 4(*a*).

Radio waves coming into the hemispherical lens 14 parallel to each other are reflected by the reflecting plate 13 and bent so as to converge on a focal point due to the fact that the shells forming the hemispherical lens 14 are formed of dielectric materials having different dielectric constants from each other. This focal point is calculated from the azimuth angle and incidence angle of the incoming radio waves, and one of the feeds 16 is moved to this focal point beforehand to collect the radio waves from the geostationary satellite. Since the reflecting plate 13 has a greater diameter than the hemispherical lens 14, incoming radio waves are partially reflected by the reflecting plate 13 outside of the hemispherical lens 14, enter the hemispherical lens 14, and converge on the focal point. This improves the gain of the antenna.

The lens antenna assembly of the first embodiment has the two feeds 16*a* and 16*b* so that it can receive radio waves from a plurality of geostationary satellites. In FIGS. 4(*a*) to 4(*c*), only one of the feeds is shown. It is to be understood that the other feed is hidden by the lens 14 in these figures. When receiving radio waves from an orbiting satellite, it is necessary to move the feed shown in FIGS. 4(*a*) to 4(*c*) according to the changing position of the orbiting satellite. But as far as the orbiting satellite is at a high position and radio waves therefrom are at an intermediate incidence angle, it is not necessary to incline the reflecting plate 13.

To receive radio waves from a geostationary satellite located at such a high position that the incidence angle of radio waves from the satellite is less than 20 degrees (see FIG. 4(*b*)), the pulling means 23 of the reflecting plate support means 20 are actuated to incline the reflecting plate 13 until the incidence angle of radio waves from the satellite increases to 20 degrees or higher, preferably 45 degrees or higher. In particular, the azimuth angle and the incidence angle of the incoming radio waves are calculated, and the pulling means 23 are synchronously driven so as to raise the side of the reflecting plate 13 from which radio waves enter.

By adjusting the inclination angle of the reflecting plate 13 in the above manner, the feed will move out of the path of incoming radio waves and thus will not interfere with incoming radio waves. This improves the gain of the antenna.

Conversely, if the incidence angle of radio waves is higher than 80 degrees as shown in FIG. 4(*c*), the pulling means 23 are controlled to lower the side of the reflecting plate 13 from which radio waves enter, thereby reducing the incidence angle of radio waves to 80 degrees or lower, preferably 60 degrees or lower. This control is necessary e.g. when receiving radio waves from an orbiting satellite and/or if the antenna assembly is located near the equator. This control is also carried out by calculating not only the incidence angle but the azimuth angle of incoming radio waves.

As described above, if the incidence angle of radio waves is outside of the preferred range of 20 to 80 degrees, the pulling means 23 are actuated to incline the reflecting plate 13 such that the incidence angle of radio waves will be within the range of 20 to 80 degrees, preferably within the range of 45 to 60 degrees. The pulling means 13 have to have strokes sufficiently large to achieve this purpose. The reflecting plate support means 20 is not limited to the one shown. For example, it may comprise a short support post having legs at the bottom end, a universal joint having a spherical coupling member and mounted on the top end of the support post, and pulling means through which the support post is coupled to the base plate 11.

The diameter of the reflecting plate 13 is theoretically R/cos θ (where R is the diameter of the hemispherical lens 14 and θ is the incidence angle of radio waves). In the present invention, the diameter of the reflecting plate 13 is determined to be R/cos 20 degrees or over.

Figure 5:
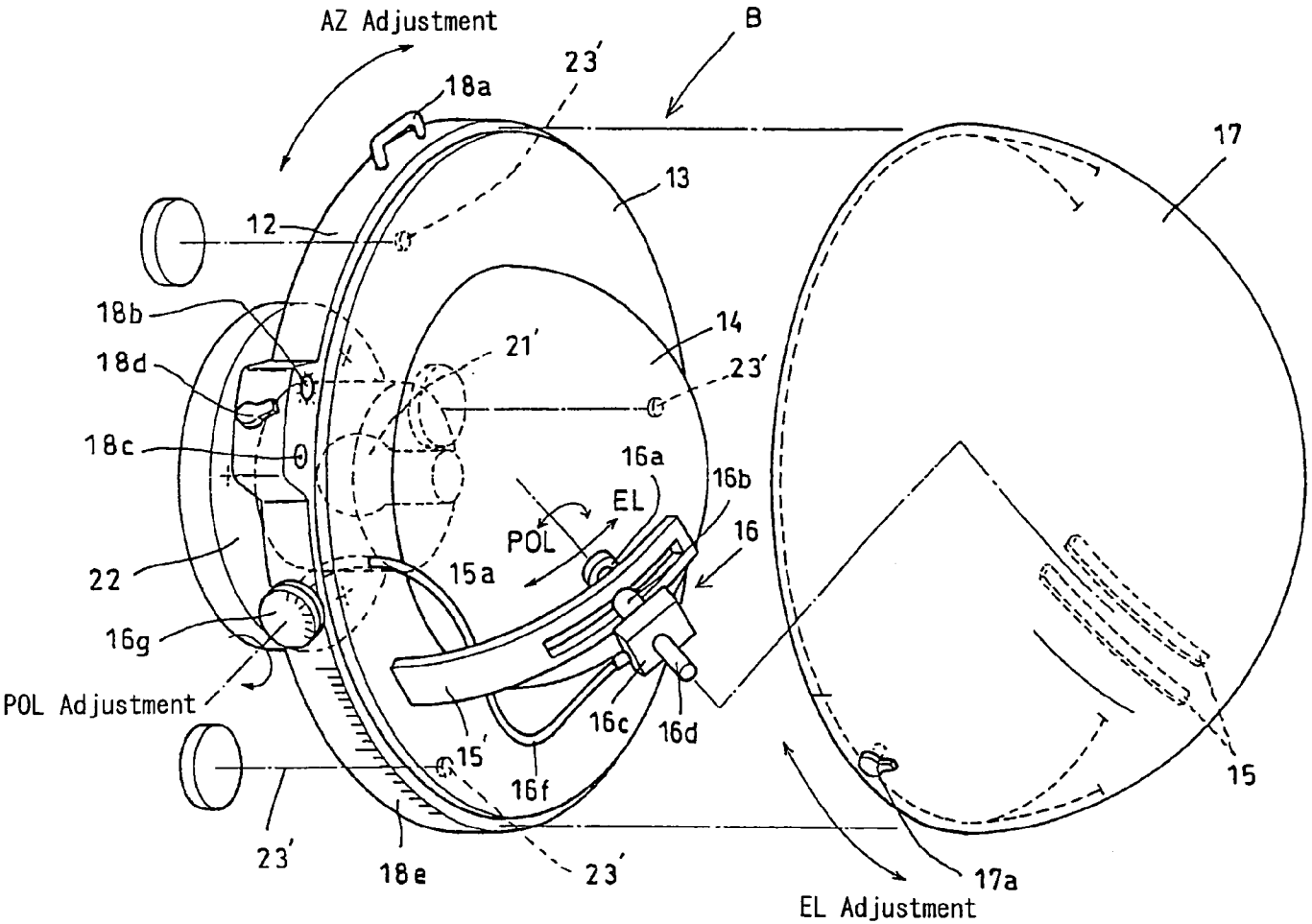
FIG. 5 is a perspective view of a lens antenna assembly according to a second embodiment.

FIG. 5 shows a perspective view of the lens antenna assembly according to the second embodiment. The lens antenna assembly of the second embodiment, which is generally designated B, is also a Luneberg lens antenna assembly. While the antenna assembly of the first embodiment includes two feeds so as to receive radio waves from two geostationary or orbiting satellites, the antenna assembly of the second embodiment has only one feed 16 and thus can receive radio waves from one satellite only, and is adapted to be hung on a wall. The second embodiment includes many elements that are identical or similar to those of the first embodiment. These elements are denoted by identical numerals and their description is omitted.

As shown, the lens antenna assembly B comprises a disk-shaped base plate 11, a turntable 12, a radio wave reflecting plate 13, a hemispherical lens 14, a guide plate 15', a single feed 16, and a radome 17. Of these elements, the elements other than the guide plate 15' and the feed 16 are identical to those of the first embodiment. The guide plate 15' guides and moves the feed 16 to a predetermined angular position relative to the hemispherical lens 14 in cooperation with guide rails 15 mounted to the inner surface of the radome 17 so as to extend oblique to the guide plate 15'. The turntable 12 is rotatably mounted on the base plate 11 through a bearing, not shown. The radome 17 is mounted on the turntable 12 so as to be rotatable within a restricted range relative to the turntable 12.

The guide plate 15' curves along the surface of the hemispherical lens 14, and is formed with an elongated hole (slit) 15*a* near its top end, in which the feed 16 is slidably mounted. The feed 16 comprises an antenna element 16*a*, a slider 16*b*, a polarization angle adjuster 16*c* and a pin 16*d*. The polarization angle adjuster 16*c* adjusts the polarization angle of radio waves received and/or radio waves to be transmitted. The pin 16*d* is trapped between the two guide rails 15, which extend oblique to the guide plate 15'. Thus, when the radome 17 is rotated about the AZ axis relative to the turntable 12, the pin 16*d* will move along the guide rails 15. Thus, the feed 16 moves in the elongated hole 15*a* of the guide plate 15' along the surface of the hemispherical lens 14.

A flexible cable 16*f* has one end thereof connected to the polarization adjuster 16*c* of the feed 16 and the other end connected to a polarization angle adjustor dial 16*g*. The polarization adjuster dial 16*g* is connected to an external transmitter/receiver, not shown. Thus, by turning the adjuster dial 16*b*, a polarization axis is adjustable to a desired angle. Numeral 18*a* is a grip for carrying the antenna assembly, 18*b* is a directional magnet, 18*c* is a level, 18*d* is a locking member for locking the turntable 12 to prevent it from turning, and 18*e* is a graduation for adjusting the EL shafts. Numeral 17*a* indicates a locking knob for preventing rotation about the EL shafts and is provided at the joint portion between the radome 17 and the turntable 12.

Figure 6:
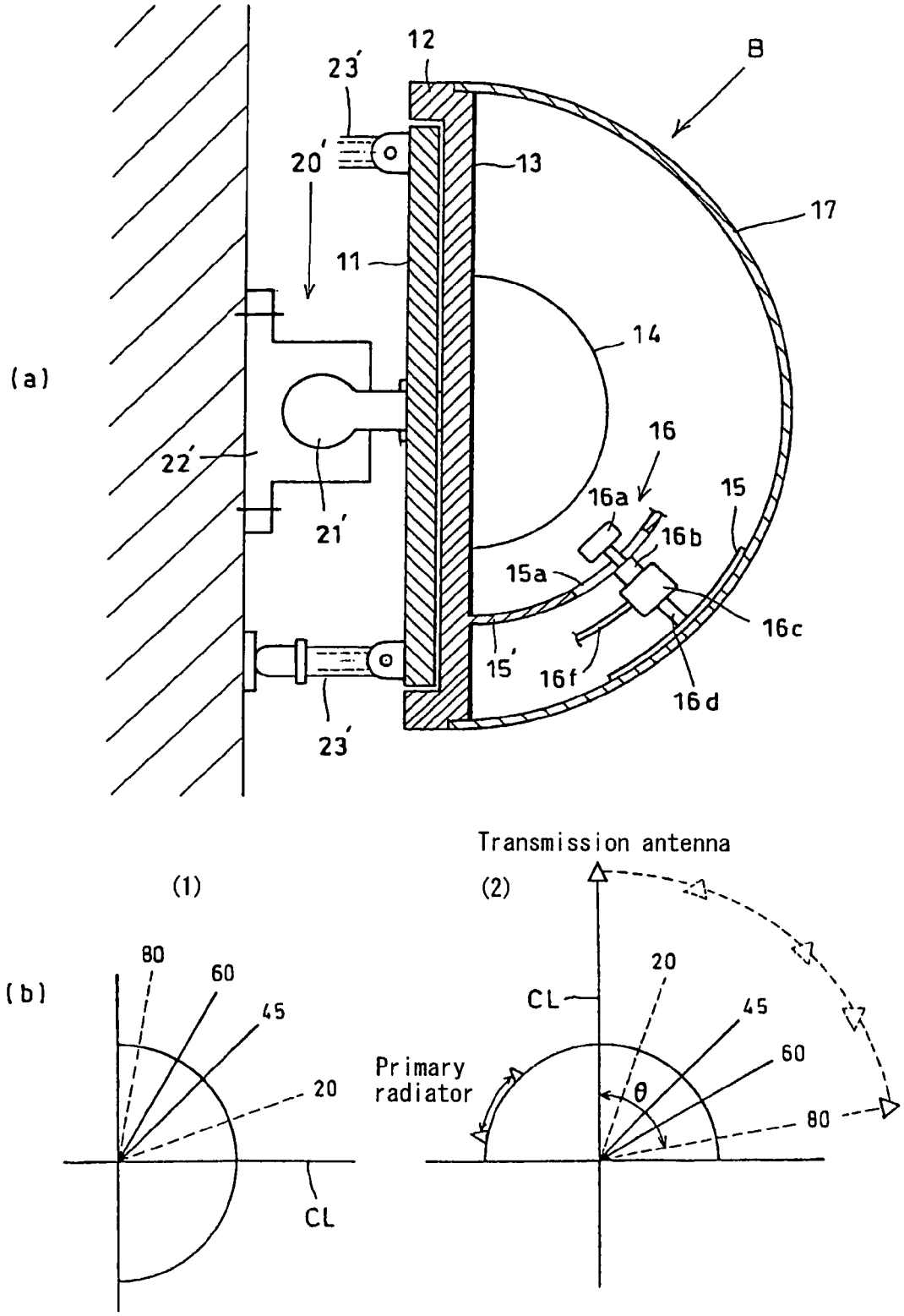
FIGS. 6(*a*) and 6(*b*) are vertical sectional views of the same.

In order that the lens antenna assembly B can be hung on a wall, a reflecting plate support means 20' is provided on the back of the base plate 11 as shown in FIG. 6(*a*). The reflecting plate support means 20' comprises a ball shaft 21', a bearing member 22' rotatably supporting the ball shaft 21', and three angle adjusters 23' for adjusting the support angle of reflecting plate within a predetermined angle. The ball shaft 21' is formed with a ball portion at one end thereof and has its other end fixed to the back of the base plate 11. The ball portion is received in a spherical recess formed in the bearing member 22'. The bearing portion 22' is secured to a vertical wall of a building by means of e.g. bolts passed through its flange portion.

The three angle adjusters 23' are provided on the base plate 11 so as to be circumferentially spaced apart from each other by 120 degree. Each angle adjuster comprises a hollow rod having one end thereof fixed to the base plate 11 and formed with an internal thread, and a threaded rod inserted in the hollow rod and having its external thread in threaded engagement with the internal thread of the hollow rod. The threaded rod has a rounded end pressed against the vertical wall preferably through a support member fixed to the wall. By turning the threaded rod, the length of each angle adjuster 23' is adjustable.

As with the first embodiment, the lens antenna assembly B is also used to receive radio waves from a satellite or transmit radio waves to a satellite through the feed 16. As with the feeds of the first embodiment, the feed 16 of this embodiment is moved to a position where radio waves can be received or transmitted with the highest gain. Since the antenna assembly of the embodiment is hung on a vertical wall, it is different in the relationship between the incidence angle of radio waves and the position of a satellite from e.g. the antenna assembly of the first embodiment.

FIGS. 6(*b*)-1 and 6(*b*)-2 show the incidence angle of radio waves from a satellite in the antenna assembly of the second embodiment and the incidence angle of such radio waves in the antenna assembly of the first embodiment, respectively. The incidence angle of radio waves is the angle between the central axis CL of the hemispherical lens 14 and the incoming radio waves. In FIG. 6(*b*)-1, the central axis CL is horizontal. In FIG. 6(*b*)-2, the central axis CL is vertical. Thus, in FIG. 6(*b*)-1, the relationship between the value of the incidence angle and the height of the satellite is completely reverse to such relationship in FIG. 6(*b*)-2. Specifically, in FIG. 6(*b*)-1, the greater the incidence angle, the higher the satellite position, while in FIG. 6(*b*)-2, the greater the incidence angle, the lower the satellite position.

It will be apparent from the above description that radio waves can be received and transmitted in a reliable and sufficient manner even when the lens antenna assembly is hug on a vertical wall with the base plate 11 extending vertically parallel to the vertical wall. With the antenna lens assembly hung on a vertical wall, the turntable 12 and the reflecting plate 13 are turned to move the feed 16 to a position corresponding to the azimuth angle of the incoming radio waves. The radome 17 is then turned relative to the turntable 12 to move the feed 16 to the focal point of the hemispherical lens 14.

If the incidence angle of incoming radio waves is outside of the range of 20 to 80 degrees because the antenna assembly is located outside Japan or radio waves are being transmitted from an orbiting satellite, or if the incidence angle is near 20 or 80 degrees and it is desired to correct the incidence angle to a value within the preferable range of 45 to 60 degrees, one, two or all of the angle adjustors 23' are extended or shrunk to incline the reflecting plate 13, thereby adjusting the incidence angle to a desired value.

As in the first embodiment, by selectively extending or shrinking the respective angle adjusters 23', the turntable 12, the reflecting plate 13 and the hemispherical lens 14 can be inclined in any direction to correct the incidence angle of radio waves to a value within an optimum range.

Instead of hanging on a vertical wall, the antenna assembly B of the second embodiment can be set horizontally in the same manner as the antenna assembly of the first embodiment or any other conventional antenna assembly. Conversely, by replacing the reflecting plate support means 20 of the first embodiment with the reflecting plate support means 20' of the second embodiment, the lens antenna assembly A of the first embodiment can be hung on a vertical wall.

The lens antenna assembly B of the second embodiment can receive or transmit radio waves from and to a single satellite. But it can be modified so as to receive or transmit radio waves from and to a plurality of (e.g. 4 to 5) satellites that are located sufficiently close to each other. For this purpose, additional (3 to 4) guide plates 15' identical to the guide plate 15' shown are mounted adjacent to each other and to the latter guide plate, and additional feeds 16 identical to the feed 16 shown are mounted in the respective additional guide plates 15' so that each of the feed shown and the additional feeds corresponds to one of the plurality of satellites. Also, corresponding to the additional guide plates 15', additional guide rails 15 are provided on the inner surface of the radome 17.

If the antenna assembly of either the first or second embodiment is used to receive or transmitted radio waves from and to an orbiting satellite, one of the feeds or the feed is moved following the satellite.

EXAMPLES

Example 1

A lens antenna assembly B according to the second embodiment was prepared and installed as shown in FIG. 6(*b*)-1 to receive radio waves with the incidence angle varied within a range of 45 to 60 degrees. The relationship between the gain of the antenna assembly of Example 1 and the incidence angle is shown by the curve indicated by the symbol ■ in FIG. 7.

Reflecting plate 13: 640 mm in diameter

Hemispherical lens 14: 450 mm in diameter

The number of layers forming the lens: 8

Figure 7:
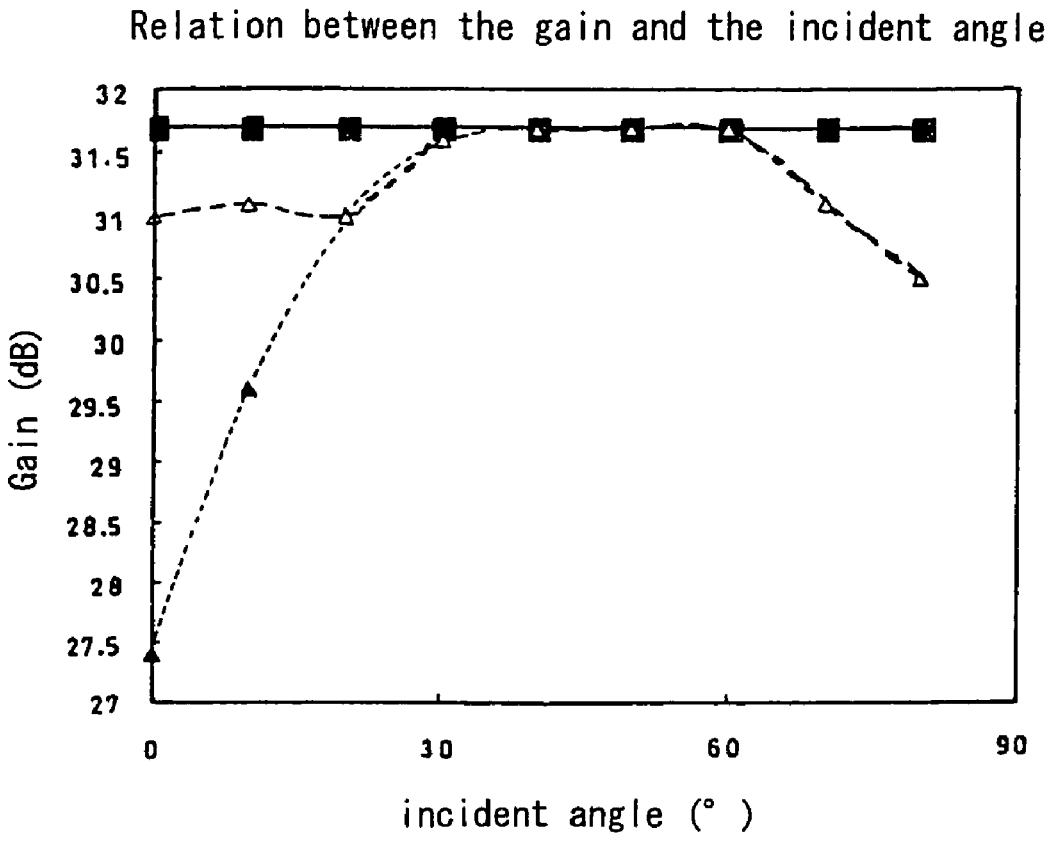
FIG. 7 is a graph showing the gains of the lens assembly according to the present invention.
Figure 8:
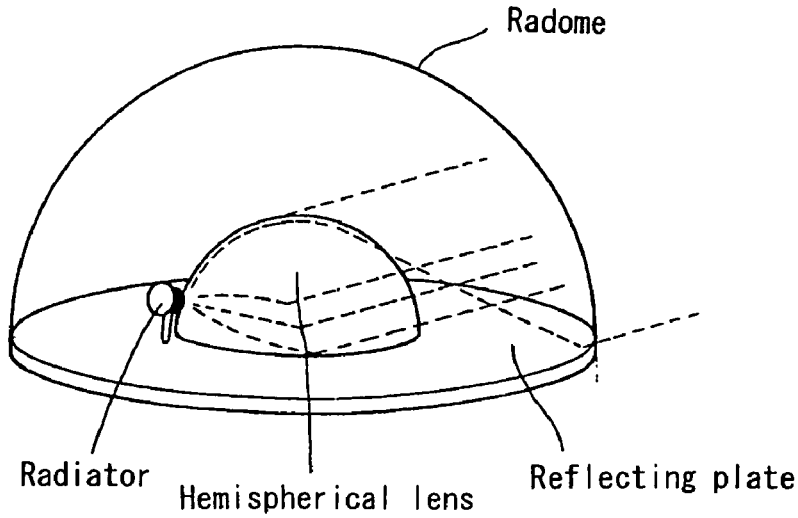
FIGS. 8(*a*) and 8(*b*) show conventional lens antenna assemblies.
Figure 8:
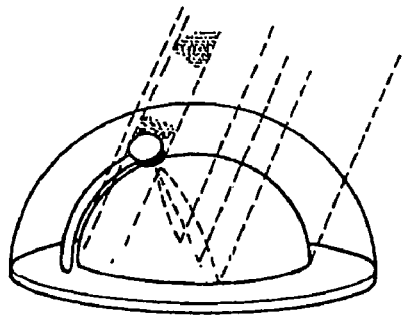

As will be apparent from the graph of FIG. 7, the maximum gain was obtained at any position of the antenna, in spite of the fact that the antenna assembly of Example 1 was fairly compact in size.

Example 2

A lens antenna assembly B according to the second embodiment was prepared and installed as shown in FIG. 6(*b*)-1 to receive radio waves with the incidence angle varied within a range of 20 to 80 degrees. The relationship between the gain of the antenna assembly of Example 2 and the incidence angle is shown by the curve indicated by the symbol Δ in FIG. 7.

Reflecting plate 13: 900 mm in diameter

Hemispherical lens 14: 450 mm in diameter

The number of layers forming the lens: 8

As will be apparent from the graph of FIG. 7, the gain was sufficiently high at any antenna position.

Comparative Example

A lens antenna assembly identical to Example 2 except that the reflecting plate was fixed was prepared, and installed as shown in FIG. 6(*b*)-1 to receive radio waves. The relationship between the gain of the antenna assembly of Comparative Example and the incidence angle is shown by the curve indicated by the symbol ▲ in FIG. 7.

Reflecting plate 13: 1400 mm in diameter

Hemispherical lens 14: 450 mm in diameter

The number of layers forming the lens: 8

The gain dropped markedly in ranges below 20 degrees and above 80 degrees. A large antenna assembly was large, so that handling was inconvenient.

ADVANTAGES OF THE INVENTION

As described above, the lens antenna assembly according to the present invention comprises a hemispherical lens made of a dielectric material, a radio wave reflecting plate having a larger diameter than the hemispherical lens and provided on the cut surface of the hemispherical lens, a feed having an antenna element and movable to a focal point of the hemispherical lens on which incoming radio waves converge, and a reflecting plate support means supporting the reflecting plate such that the reflecting plate support means can incline the reflecting plate. Because it is possible to adjust the inclination angle of the reflecting plate with the reflecting plate support means such that the incidence angle of radio waves will be within a predetermined range, radio waves can be received and transmitted with a high gain from and to not only a geostationary satellite but an orbiting satellite, irrespective of the latitude where the satellite is located, e.g. even if the satellite is on the equator by changing the inclination angle of the reflecting plate.

What is claimed is:

1. A lens antenna assembly comprising a hemispherical lens made of a dielectric material for converging radio wave, a radio wave reflecting plate having a greater diameter than the hemispherical lens and provided on the flat surface of the hemispherical lens, a feed for receiving and transmitting radio wave, the feed being movable to a focal point of the hemispherical lens, and a reflecting plate support means for supporting the radio wave reflecting plate so as to be inclinable in any desired direction, thereby adjusting the inclination angle of the reflecting plate such that the incidence angle of radio waves incident on the hemispherical lens will be within a predetermined range.

2. The lens antenna assembly of claim 1 further comprising a position setting means for moving the feed to the focal point, the position setting means comprising an azimuth angle setting means for controlling the azimuth angle of the feed in a direction in which radio waves enters the hemispherical lens by moving the feed around an azimuth axis of the hemispherical lens, and an elevation angle setting means for controlling the elevation angle of the feed in a direction in which radio waves enters the hemispherical lens by moving the feed around an elevation axis of the hemispherical lens.

3. The lens antenna assembly of claim 1 or 2 wherein the reflecting plate support means comprises a base, a hemispherical or spherical member pivotally mounted on the base and supporting the reflecting plate, and an inclination angle setting means connected to the base.

4. The lens antenna assembly of claim 3 wherein the inclination angle setting means includes a mechanism for adjusting the inclination of the reflecting plate by inclining the reflecting plate if an incidence angle of radio waves incident on the hemispherical lens is outside of a predetermined range of 20 to 80 degrees so that the incidence angle will be within the range of 20 to 80 degrees.

5. The lens antenna assembly of claim 4 wherein the incidence angle is 45 to 60 degrees.

6. The lens antenna assembly of claim 5 further comprising a radome for protecting the hemispherical lens and the feed.

* * * * *